US006228139B1

(12) United States Patent
Oskarsson

(10) Patent No.: US 6,228,139 B1
(45) Date of Patent: May 8, 2001

(54) FINE-GRAINED WC-CO CEMENTED CARBIDE

(75) Inventor: Rolf Oskarsson, Rönninge (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/558,228

(22) Filed: Apr. 26, 2000

(30) Foreign Application Priority Data

May 5, 1999 (SE) ..... 9901590

(51) Int. Cl.[7] ..... B22F 3/12; C22C 1/05
(52) U.S. Cl. ..... 75/240; 419/18; 419/38
(58) Field of Search ..... 419/18, 38; 75/240

(56) References Cited

U.S. PATENT DOCUMENTS

| | | | | |
|---|---|---|---|---|
| 3,660,050 | * | 5/1972 | Iler et al. | 29/182.8 |
| 4,684,401 | | 8/1987 | Ladd et al. . | |
| 4,894,090 | * | 1/1990 | Ekemar et al. | 75/252 |
| 4,923,512 | * | 5/1990 | Timm et al. | 75/239 |
| 4,950,328 | | 8/1990 | Niro et al. . | |
| 5,032,174 | * | 7/1991 | Ekemar et al. | 75/354 |
| 5,110,349 | * | 5/1992 | Westergren et al. | 75/233 |
| 5,380,688 | * | 1/1995 | Dunmead et al. | 501/87 |
| 5,563,107 | * | 10/1996 | Dubinsky et al. | 501/87 |
| 5,612,264 | * | 3/1997 | Nilsson et al. | 501/87 |
| 5,773,735 | * | 6/1998 | Dubensky et al. | 75/240 |
| 5,882,376 | * | 3/1999 | Kim et al. | 75/352 |
| 5,885,372 | * | 3/1999 | Seegopaul | 148/237 |
| 5,948,523 | * | 9/1999 | Carpenter et al. | 428/325 |

FOREIGN PATENT DOCUMENTS

| | | |
|---|---|---|
| 819 490 | 1/1998 | (EP) . |
| 98/03690 | 1/1998 | (WO) . |
| 98/03691 | 1/1998 | (WO) . |
| 99/13120 | 3/1999 | (WO) . |

OTHER PUBLICATIONS

M. Leiderman et al., "Sintering, Microstructure and Properties of Submicron Cemented Carbide," *Plansee Proceedings*, vol. 2, Cemented Carbides and Hard Materials, XP002145388, 1997, pp. 718–279.

W. D. Schubert et al, "Harndess to toughness relationship of fine–grained WC–Co hardmetals," *International Journal of Refractory Metals & Hard Materials*, XP002145389, 16, 1998, pp. 133–142.

H. W. Daub et al., "Performance potentials of super–fine and ultra–fine grained hard alloys and their manufacture," *Deutsche Gesellschaft fur Metallkunde*, pp. 285–306.

* cited by examiner

*Primary Examiner*—Daniel Jenkins
(74) *Attorney, Agent, or Firm*—Burns, Doane, Swecker & Mathis, L.L.P.

(57) ABSTRACT

The present invention relates to a method of making a WC—Co-based cemented carbide with a sintered mean WC-grain size in the range 0.4–1.6 μm. the cemented carbide is produced from well deagglomerated or easy to deagglomerate WC powder with round morphology, a Co powder also well deagglomerated or easy to deagglomerate and with a grain size equal to or smaller than the WC grain size and grain growth inhibitors. According to the invention the metal part of the grain growth inhibitors is added as part of the binder phase i.e., is included in the Co powder and alloyed therewith.

8 Claims, No Drawings

FINE-GRAINED WC-CO CEMENTED CARBIDE

FIELD OF THE INVENTION

The present invention relates to an improved method of making fine-grained WC-Co cemented carbide.

BACKGROUND OF THE INVENTION

Cemented carbides for metal cutting have been used for almost 70 years. All the time improvements have been made and higher productivity has been achieved. One of the biggest inventions in this area was the coatings with thin layers of TiC, TiN, $Al_2O_3$ etc., which have increased the metal removal rate of such tools considerably. The coatings have also been developed by techniques including initial high temperature chemical vapour deposition (HT-CVD) towards lower deposition temperature (MT-CVD) and also Physical Vapour Deposition (PVD). The thickness and the adherence of the coatings have been improved as well which have changed the compositions for the cemented carbide substrates. Previously these substrates often formed an active part of the cutting tool. However, today the main function of the substrate material is to carry a coating, with the coating being the active cutting material. Once the coating is worn out, the coated substrate, often in the form of a removable insert, is simply discarded.

Substrate developments have included reducing the content of cubic carbides, i.e., towards WC—Co-based cemented carbide substrates. These developments lead to a demand for finer WC grain size in the sintered cemented carbide than previously attained.

Extremely fine-grained WC—Co cemented carbides have been developed for drilling of composite printed circuit boards and similar applications. Here not only submicron but also so called 'nano-sized' materials are available. The limit for 'nano-sized' is not defined in detail, but up to 200 nm (0.2 $\mu$m) is often considered as nano-size. Special production methods are used for these types of materials.

This invention relates to WC—Co-based cemented carbides produced from raw materials made via 'traditional' ways, i.e. tungsten carbide powder produced separately by carburizing of tungsten metal powder or tungsten oxide with carbon and cobalt powder. Gas-carburizing is of course included. The precipitation of a cobalt salt on the surface of tungsten carbide followed by reduction to metallic cobalt is consequently excluded.

The sintered mean WC grain sizes for alloys with improved properties if produced via the present invention are in the area 0.6–1.6 $\mu$m, preferably 0.6–1.4 $\mu$m. Also 0.4 $\mu$m WC alloys can advantageously be produced according to the present invention.

For submicron material, grain growth inhibitors must be used: $Cr_3C_2$ and/or combinations of VC+$Cr_3C_2$ can be used for finer grain sizes.

All cubic carbides in Groups IV and V of the periodic table act as grain growth inhibitors for WC—Co-alloys: TiC, ZrC, HfC, VC, NbC, and TaC. In addition, the hexagonal $Mo_2C$ and the orthorombic $Cr_3C_2$ of Group VI act as grain growth inhibitors. For WC—Co alloys with a sintered mean WC grain size of 1.0–1.6 $\mu$m, TaC is a very common grain size stabilizer/grain growth inhibitor, NbC is also often used in combination with TaC. $Mo_2C$ can be used as well, both in the submicron and micron grain size area (0.8–1.6 $\mu$m).

The traditional way to produce cemented carbide is to put the desired proportions of WC, Co and grain growth inhibitors, if any, and a pressing agent like PEG or A-vax, in a wet ball mill with milling bodies of WC—Co (in order to avoid unwanted impurities in the material) and to extensively mill this mixture in alcohol/water or any other milling liquid. The final grain size of the tungsten carbide is determined during this process. The tungsten carbide is often strongly agglomerated, and this is also true for the cobalt powder. The milling process is often very long in order to:

1. Determine the final grain size of the tungsten carbide.
2. Get an even dispersion of the grain growth inhibitors to avoid grain growth in any part.
3. Have the cobalt evenly dispersed to avoid porosity and cobalt lakes in the sintered material.

This long milling time is detrimental for at least the following reasons:

1) Wear of the milling bodies
2) Wear of the inner walls of the mills (high maintenance cost)
3) Investment costs in a lot of mills to produce the desired amount of material A long milling time will also create a very wide distribution in grain size of the milled WC particles. The numerous consequences of this broad distribution include: high compaction pressure with high deflection at unloading of the punch and high risk for cracks with modern complicated geometries, and the formation of unfavourable morphologies of the sintered WC grains (triangular, prismatic etc) resulting in low toughness (transverse rupture strength).

After milling, the slurry must be dried, often in a spraydryer, to get a free-flowing powder. This powder is then pressed and sintered to blanks followed by grinding to the final dimensions, and often coated.

SUMMARY OF THE INVENTION

An object of the present invention is to avoid the production disadvantages described above and also to increase the performance level for the sintered material, mainly the toughness.

In one aspect, the present invention provides a method of making a WC—Co-based cemented carbide with a sintered mean WC-grain size in the range 0.4–1.6 $\mu$m, wherein the method comprises the steps of:

(a) providing a WC powder with a round morphology;

(b) providing a Co powder alloyed with at least one grain growth inhibitor; and (c) mixing the WC powder and the Co powder.

DETAILED DESCRIPTION OF PREFERRED EMBODIMENTS

According to the present invention, a cemented carbide material can be produced from the following raw materials and techniques.

A well defined, narrow grain size WC raw material with rounded morphology is used in which the final (sintered) grain size is already determined when it is produced via reduction/carburizing. The WC must be deagglomerated into single grains or be easy to deagglomerate. If a cemented carbide with a sintered WC mean grain size of 1.3 $\mu$m is wanted, this means that the original WC must have a mean grain size of about 1.0–1.2 $\mu$m because a certain small, but controlled, grain growth can never be avoided.

A well defined, narrow grain sized Co raw material, also with rounded morphology and with a mean grain size equivalent to or smaller than the meam WC grain size with which it will be mixed is selected. The cobalt powder must also be easy to deagglomerate. Advantageously, this Co raw material already includes at least the metal part of the grain growth inhibitors, i.e., the addition of the grain growth inhibitor is part of the Co powder production process. This means that also the cobalt is 'tailor made' for the final sintered alloy, because the amount and type of grain growth inhibitor additions are dependent on both final (sintered) WC grain size and the amount of binder phase desired.

A blending/mixing of the components can be utilized rather than a traditional milling procedure.

The use of the concepts outlined above gives a cemented carbide with better production economy combined with better compacting properties (less cracks and better tolerances, i.e.—better shape stability) and increased toughness. The toughness increase is due to a better morphology with more rounded and less triangular and prismatic WC grains. With the grain growth inhibitors present where they are wanted/needed, i.e.—the contact surfaces between Co and WC, the amount of grain growth inhibitors can often be decreased. Because these inhibitors, especially VC, are well known to decrease the toughness, a decrease of these elements is desirable. The same grain growth inhibiting effect with decreased amounts of inhibitors is possible because they are placed where they are needed, and a better toughness can be achieved.

The invention is suitable for additions of up to 3, preferable up to 2, weight-% of V and/or Cr, Ti and Ta and/or Nb.

EXAMPLE 1

Two powder batches were produced, one according to established technology and one according to the invention.

Known technique:

89.5 w/o WC, 0.8 μm (FSSS)

10.0 w/o Co standard (1.5 μm)

0.5 w/o $Cr_3C_2$

Milling time: 30 h

Invention:

89.5 w/o WC, 0.70 μm (FSSS)

10.43 w/o Co—Cr (0.65 μm)

0.07 w/o C (carbon compensation)

Milling time: 3 h

The Co—Cr alloy according to the invention contains Co/Cr in the proportions 10/0.43, and is easy to deagglomerate as is the WC according to the invention.

The mills were identical as well as the total amount of powder in the mills. The slurries were spray dried with the same process parameters.

The two powders were pressed to insert blanks, SNUN 120308, in tools for 18% shrinkage when sintering.

The compacting pressure was 145 MPa for the powder produced according to existing technique and 110 MPa for powder according to the invention.

Desired pressure is 100±20 MPa.

The pressed compacts were then sintered in the same batch and had the same hardness in as-sintered condition, 1600±25 HV3.

EXAMPLE 2

The same powders as in example 1 were utilized, test pieces 5.5×6.5×21 mm were produced. They were sintered together and then tested in a 3-point bending test with the following results, mean values:

| Known technique | Invention |
|---|---|
| 2725 ± 300 MPa | 3250 ± 200 MPa |

EXAMPLE 3

Two alloys with the same macro composition were made, one according to the present invention and one according to known technique.

| Known technique | |
|---|---|
| 93.5 w/o WC | 1.2 μm FSSS |
| 6.0 w/c Co standard | (1.5 μm) |
| 0.5 w/o TaC | |
| Milling time: 40 h | |
| Invention | |
| 93.5 w/o WC | 1.0 μm (FSSS) |
| 6.4 w/o Co-Ta | 0.8 μm |
| 0.1 w/o C (carbon compensation) | |
| Milling time: 4 h | |

The two variants were produced according to example 1. When pressing the same test inserts, SNUN 120308, the compacting pressure for 18% shrinkage was 160 MPa for the powder according to existing technique and 115 MPa for the powder according to the invention. After sintering, both variants had the same hardness, 1750±25 HV3.

The foregoing has described the principles, preferred embodiments and modes of operation of the present invention. However, the invention should not be construed as being limited to the particular embodiments discussed. Thus the above-described embodiments should be regarded as illustrative rather than restrictive, and it should be appreciated that variations may be made in those embodiments by workers skilled in the art without departing from the scope of the present invention as defined by the following claims.

I claim:

1. A method of making a WC—Co-based cemented carbide with a sintered mean WC-grain size in the range 0.4–1.6 μm, wherein the method comprises the steps of:

(a) providing a WC powder with a round morphology;

(b) providing a Co powder alloyed with at least one grain growth inhibitor; and (c) mixing the WC powder and the Co powder.

2. The method according to claim 1 wherein the Co-powder has a mean grain size equal to or smaller than the WC-powder mean grain size.

3. The method according to claim 1, wherein the sintered mean WC grain size is 0.6–1.4 μm.

4. The method according to claim 1, wherein the grain growth inhibitor comprises $Cr_3C_2$.

5. The method according to claim 1, wherein the method further comprises:

(d) compacting the mixed WC and Co powders to form a compacted body; and (e) sintering the compacted body.

6. A cutting tool comprising a WC—Co based cemented carbide body having a mean WC grain size in the range of 0.4–1.6 μm produced by the method of claim 5.

7. The method according to claim 1, wherein the Co-powder has a round morphology.

8. The method of claim 1, wherein at least the metal part of the grain growth inhibitor is included during production of the Co powder.

* * * * *